US005185807A

United States Patent [19]

Bergin et al.

[11] Patent Number: 5,185,807

[45] Date of Patent: Feb. 9, 1993

[54] HEADSET WITH MULTI-POSITION STIRRUP ASSEMBLIES

[75] Inventors: James T. Bergin, Rochdale; Richard M. Urella, Shrewsbury, both of Mass.

[73] Assignee: David Clark Company Incorporated, Worcester, Mass.

[21] Appl. No.: 697,325

[22] Filed: May 8, 1991

[51] Int. Cl.[5] ..... H04R 25/00

[52] U.S. Cl. ..... 381/183; 381/187; 181/128; 181/129; 248/223.2

[58] Field of Search ..... 381/183, 187; 181/128, 181/129; 248/223.2, 223.1, 222.4, 298, 188.5

[56] References Cited

U.S. PATENT DOCUMENTS 2,383,068 8/1945 MacLean, Jr. ..... 248/222.4
3,880,396 4/1975 Freiberger et al. ..... 248/223.2
4,893,777 1/1990 Gassaway ..... 248/223.1
4,897,592 1/1991 Flagg ..... 381/183
4,964,606 10/1990 Beam et al. ..... 248/188.5

*Primary Examiner*—Jin F. Ng
*Assistant Examiner*—Huyen D. Le
*Attorney, Agent, or Firm*—Samuels, Gauthier & Stevens

[57] ABSTRACT

A headset has an arcuate resilient headband with arcuate stirrups at its opposite ends carrying noise attenuating ear domes. The stirrups are coupled to the headband for pivotal movement about first parallel axes. The ear domes are coupled to the stirrups for both pivotal movement about second axes extending transversely with respect to the first axes, and translational movement toward and away from each other between multiple pivot positions located along third axes extending transversely with respect to the second axes.

5 Claims, 2 Drawing Sheets

HEADSET WITH MULTI-POSITION STIRRUP ASSEMBLIES

BACKGROUND OF THE INVENTION

This invention relates generally to headsets having ear domes adapted to attenuate noise, and is concerned in particular with an improved means for adjusting the headband clamping forces which press the ear domes against the wearer's head. As herein employed, the term "headset" is intended to encompass not only communication equipment, but also ear protectors and other like noise attenuating devices.

Proper adjustment of headband clamping force is critical to achieving optimum comfort and noise attenuation levels. Excessive force can cause discomfort, whereas insufficient force can result in an inadequate seal, which in turn allows ambient noise to enter into the ear dome cavity.

The objective of the present invention is to provide an improved headset design having multi-position stirrup assemblies which enable users to conveniently choose between a plurality of available headband clamping forces, thereby making it possible to accommodate each user's particular head size while optimizing both comfort and noise attenuation levels.

SUMMARY OF THE INVENTION

The foregoing objective, as well as other objectives and advantages to be hereinafter described in more detail, are achieved by the provision of a headset having a resilient accurate headband. A pair of mutually spaced resilient arcuates stirrups depend from and are mounted to the ends of the headband for pivotal movement about first axes. A pair of confronting mutually spaced ear domes are mounted to the ends of the stirrups for pivotal movement about second axes extending transversely with respect to the first axes. Cylindrical stud assemblies lie on the second axes and protrude from opposite sides of each ear dome. Each stud assembly has a pivot portion and a recessed shifting portion, the diameter of the shifting portion being smaller than the diameter of the pivot portion. A plurality of pivot apertures are provided in the ends of the stirrups. The pivot aperture are interconnected by and cooperate with intermediate slots to define elongate openings lying on third axes extending between the stirrups and transversely with respect to the second axes. The pivot apertures are dimensioned to axially receive and pivotally coact with the pivot portions of respective stud assemblies, with the widths of the slots being smaller than the diameters of the pivot portions of the stud assemblies and dimensioned to slidably receive the shifting portions of the stud assemblies. The stirrups are configured to resilient urge selected pivot aperture of the elongate openings into alignment with the pivot portions of respective stud assemblies, and are resiliently deformable to align the connecting slots with shifting portions of the stud assemblies in order to permit the stud assemblies to slide along the connecting slots to other of the pivot apertures.

DETAILED DESCRIPTION OF PREFERRED EMBODIMENT

Figure 1:
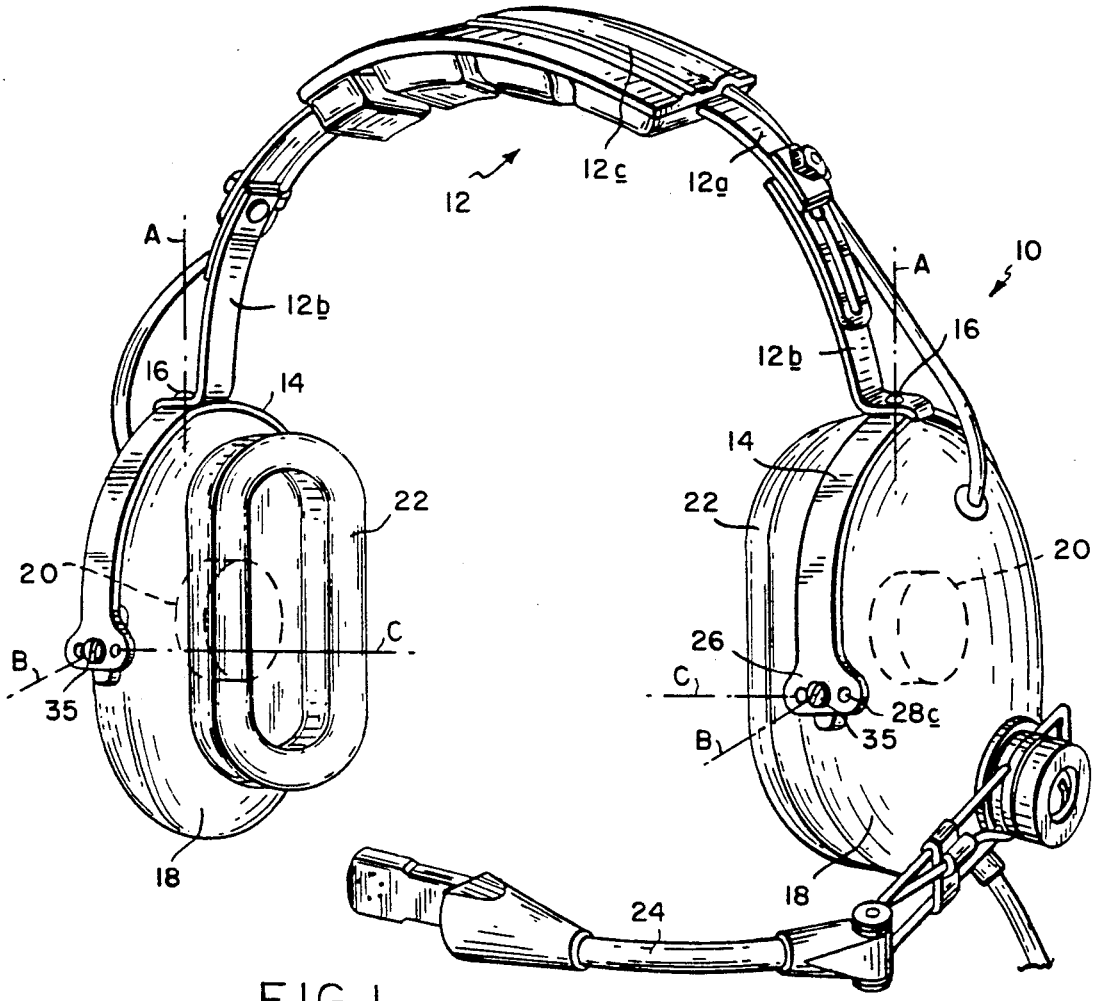
FIG. 1 is a perspective view of headset incorporating multi-position stirrup assemblies in accordance with the present invention.
Figure 2:
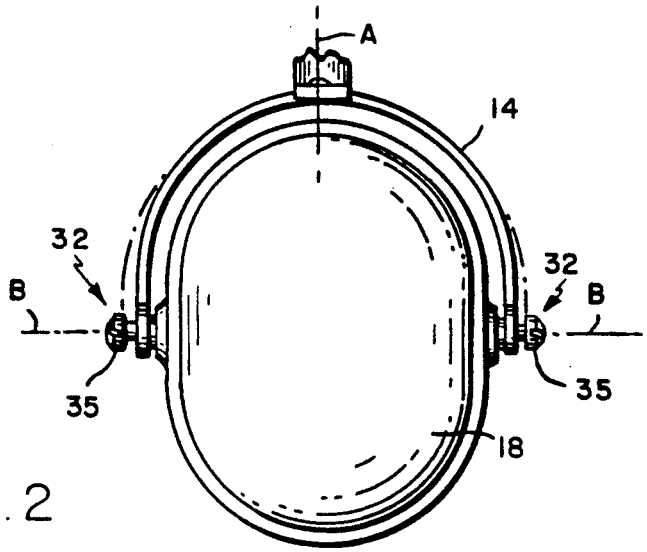
FIG. 2 is a side elevational view of one of the ear domes.
Figure 3:
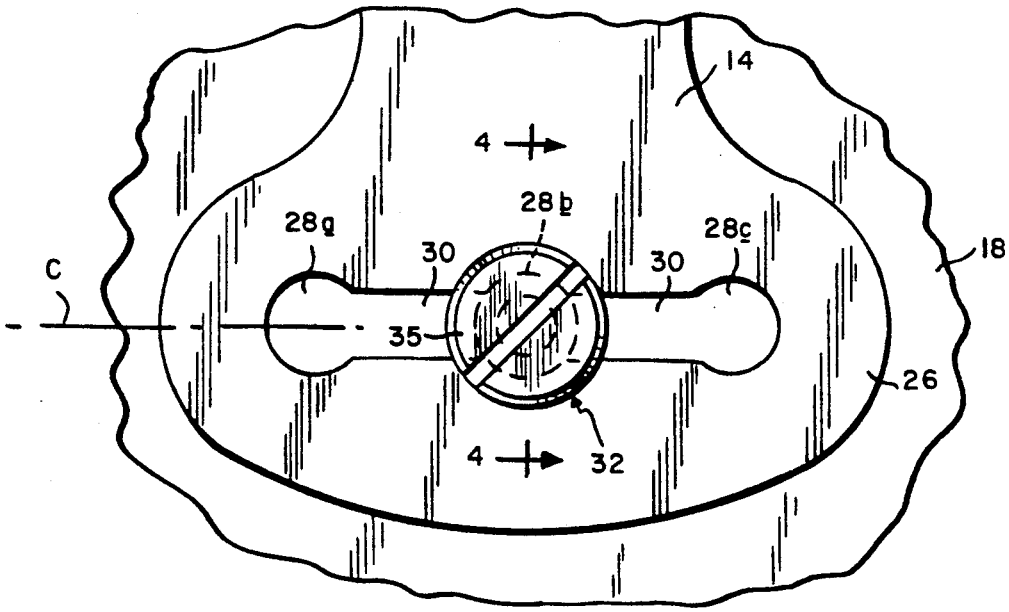
FIG. 3 is a an enlarged view of a stirrup end illustrating the multi-position feature.

Referring initially to FIG. 1, a headset of the noise attenuating type is shown at 10. The headset includes a resilient arcuate headband assembly 12 having a headband spring **12*a* adjustably connected at its opposite ends to a pair of stirrup clamps 12*b*. The headband spring 12*a* is partially encased in a cushioned headpad 12*c*. A pair of resilient multi-position stirrups 14 depend from and are mounted to the ends of stirrup clamps 12*b* by means of rivets 16 or the like. The stirrups 14 are pivotable relative to the headband assembly 12** about "first" axes A.

A pair of confronting mutually spaced noise attenuating ear domes 18 contain earphones schematically depicted at 20. The ear domes are arranged between and mounted to the ends of a respective one of the stirrups 14 for pivotal movement about "second" axes B extending transversally with respect to the first axes A. Liquid filled ear seals 22 are provided on the interior confronting faces of the ear domes, and one of the ear domes carries an adjustable microphone boom assembly 24.

Referring additionally to FIGS. 2–5, it will be seen that each stirrup end 26 is enlarged to accommodate multiple apertures **28*a*, 28*b* and 28*c*. The apertures are interconnected by and cooperate with intermediate slots 30 to define elongate openings lying on "third" axes C extending between the stirrups 14** and transversally with respect to the second axes B.

Cylindrical stud assemblies 32 lie on the second axes B and protrude from opposite sides of each ear dome. As can be best seen in FIG. 4, each stud assembly includes a stud 34 and a self locking shoulder screw 35. The stud has a square base **34*a* embedded in the ear dome 18, and a threaded cylindrical sleeve 34*b*** which defines a pivot portion lying on a second axis B and protruding from the ear dome. Each ear dome has two such stud sleeves protruding in opposite directions.

The screw 35 has a shoulder **35*a* having the same outer diameter as that of the stud sleeve 34*b*, and a reduced diameter recessed shifting portion 35*b*. During assembly, the stirrup ends 26 are resiliently spread apart and applied to the ear domes with the protruding stud sleeves 34*b* being received in selected apertures 28*a*, 28*b* or 28*c*, the diameters of which are toleranced for a slip fit to accommodate relative pivotal motion between the stirrups and ear domes about the second axes B. The screws 35** are then threaded into the stud sleeves to capture the stirrups.

The widths of the intermediate slots 30 are smaller than the diameters of the sleeves **34*b* and screw shoulders 35*a*, yet are large enough to slidably accept the recessed screw portions 35*b*. Thus, assuming that the headset was originally assembled with the stud assemblies 32 pivotally coacting with the central apertures 28*b*, and that the user desires a "tighter" fit, the ear domes 18 must be shifted inwardly in relation to their supporting stirrups 14, i.e., towards each other. This will result in a greater resilient spread of the headband assembly 12** when the headset is applied to the user's head. This greater resilient spread of the headband assembly increases the clamping forces pressing the ear domes against the user's head. A "looser" fit can be obtained by shifting the ear domes outwardly, i.e., away from each other to reduce the headband clamping forces.

Figure 4:
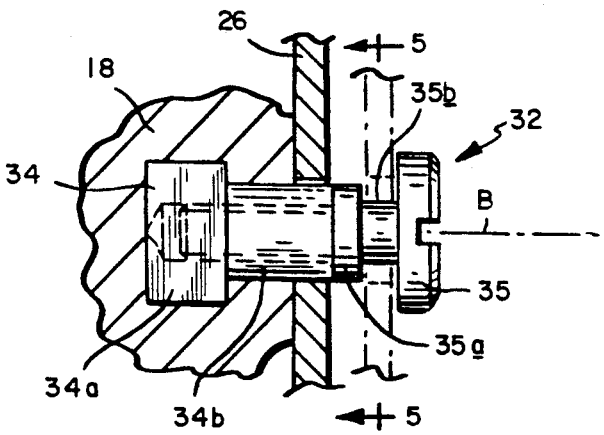
FIG. 4 is a sectional view taken along line 4—4 of FIG. 3.
Figure 5:
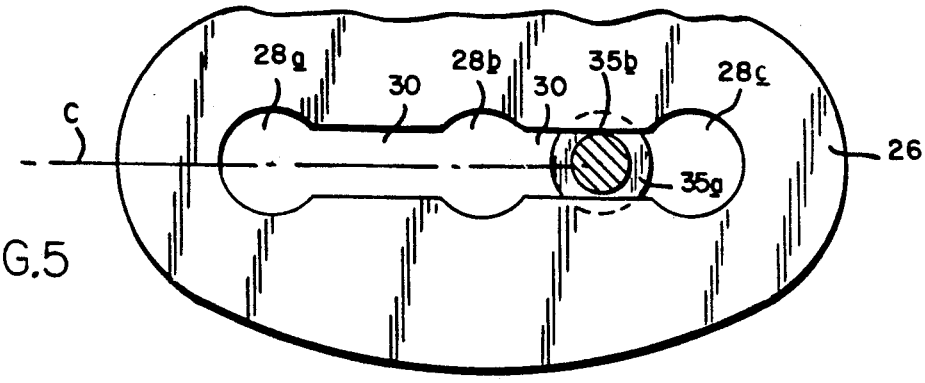
FIG. 5 is a sectional view taken along line 5—5 of FIG. 4 and showing the ear dome and stirrup end being shifted in relation to one another.

Shifting of the ear domes in relation to their respective stirrups is accomplished by first resiliently spreading each stirrup end 26 apart into alignment with the recessed screw portion 35*b* of the stud assembly (as shown by the broken lines in FIG. 4). The recessed screw portions are dimensioned to slide along the intermediate slots 30. Then, as shown in FIG. 5, the ear dome can be shifted in any desired direction to place each stud assembly 32 in alignment with a selected one of the apertures 28*a*, 28*b*, 28*c*. The stirrup end 26 is then allowed to resiliently snap back to the position shown by the solid lines in FIG. 4. Any number of apertures 28 can be employed.

It thus will be seen that by properly selecting the appropriate stirrup apertures, changes in deflection of the headband assembly can be made to accommodate a range of bitragion diameters (ear to ear breadth). Clamping force increases with deflection of the headband assembly. Adjustments can be made without disassembly of components, and without having to resort to the use of hand tools.

We claim:

1. A headset comprising:

a resilient arcuate headband;

a pair of mutually spaced resilient arcuate stirrups depending from and mounted to the ends of said headband for pivotal movement about first axes;

a pair of confronting mutually spaced ear domes mounted to the ends of said stirrups for pivotal movement about second axes extending transversally with respect to said first axes;

cylindrical stud assemblies lying on said second axes and protruding from opposite sides of each of said ear domes, each of said stud assemblies having a pivot portion and a recessed shifting portion, the diameters of said shifting portions being smaller than the diameters of said pivot portions;

a plurality of apertures in the ends of said stirrups, said apertures being interconnected by and cooperating with intermediate slots to define elongate openings lying on third axes extending between said stirrups and transversally with respect to said second axes;

said apertures being dimensioned to axially receive and pivotally coact with the pivot portions of respective stud assemblies, the widths of said slots being smaller than the diameters of said pivot portions, said slots being dimensioned to slidably receive the shifting portions of said stud assemblies, said stirrups being configured to resiliently urge selected apertures of said elongate openings into alignment with the pivot portions of respective stud assemblies, said stirrups being resiliently deformable to align said slots with the shifting portions of said stud assemblies in order to permit said stud assemblies to slide along said slots to others of said apertures.

2. The headset of claim 1 wherein said stud assemblies comprise a threaded stud member defining said pivot portion, and a shoulder screw threaded into said stud member and defining said shifting portion.

3. The headset of claim 2 wherein said stud member has a base embedded in said ear dome, and a threaded sleeve protruding from said ear dome and lying on said second axes.

4. The headset of claim 3 wherein said base in non-circular.

5. The headset of claim 3 wherein said shoulder screw has a cylindrical portion having a diameter equal to that of said threaded sleeve.

* * * * *